United States Patent [19]

Webb

[11] Patent Number: 4,852,316

[45] Date of Patent: Aug. 1, 1989

[54] EXTERIOR WALL PANEL

[75] Inventor: William Webb, Bellmore, N.Y.

[73] Assignee: Composite Panel Manufacturing, Bohemia, N.Y.

[21] Appl. No.: 120,342

[22] Filed: Nov. 13, 1987

[51] Int. Cl.[4] ..... E04H 1/00

[52] U.S. Cl. ..... 52/235; 52/811

[58] Field of Search ..... 52/235, 811, 813; 428/319.3, 446, 251, 500

[56] References Cited

U.S. PATENT DOCUMENTS 4,738,065 4/1988 Crandell ..... 52/235

*Primary Examiner*—David A. Scherbel

*Assistant Examiner*—Creighton Smith

*Attorney, Agent, or Firm*—Bauer & Schaffer

[57] ABSTRACT

A building curtain wall panel system is disclosed in which a plurality of mechanically fastened and bonded layers are provided to create a fire resistant, light weight and insulated panel which is easily installed and yet resists impact stress. The panel includes bonded layers attached to a steel frame. The strength and fire resistant properties are enhanced by a medium density calcium silicate composite panel. The exterior architectural design features may be varied by composite coatings including a variety of materials including acrylic resins, fibers, vicron, fungicide, coloring agents, cement and water.

5 Claims, 1 Drawing Sheet

EXTERIOR WALL PANEL

BACKGROUND OF THE INVENTION

1. Technical Field of the Invention

The present invention relates to a curtain wall panel system for building construction. More particularly, the present invention relates to an exterior and/or interior wall panel having a plurality of mechanically fastened and bonded layers to provide a fire resistant, light weight, insulated panel which is easily installed and yet is capable of resisting impact stress.

2. Description of the Prior Art

In general, the prior art provides several insulated wall systems. However, each include polystyrene insulation. Such systems are detrimental because of the burning characteristics of polystyrene. Such systems also have low impact resistance, creating structural problems when placed under stress.

It is this object of the present invention to provide a curtain wall panel system which is fire resistance, lightweight, resistance to impact stress and easily installed.

More specifically, it is an object of the present invention to provide a building curtain wall panel system capable of eliminating the fire hazards associated with polystyrene.

It is a further object of the invention to provide an insulated wall system which depicts not only architectural features but also which provides a system which is resistant to impact stress.

It is an additional object of the present invention to provide a light weight building wall system which insulates well.

It is yet a further object of the present invention to provide a building wall system which is prefabricated and easy to install, and which overcomes the disadvantages inherent in the prior art systems.

Further objects and advantages are set forth and/or will become apparent from the following disclosure.

SUMMARY OF THE INVENTION

The invention includes a panel system having the following mechanically fastened and bonded layers:

a steel-stud frame that is constructed from rust proof galvanized steel; a phenolic foam insulation; a medium density calcium silicate composite panel including cement, mineral fillers and treated natural organic fibers; fiberglass mesh and sizing; a composite coating including acrylic resin, fiber, vicron, fungicide, coloring agents, cement and water; and a sealer.

By incorporating a lightweight steel framing member and a rigid phenolic foam covered with a non-combustible and non-asbestos cement fiberboard that is fastened to a steel frame, and then covered with synthetic coatings, features not disclosed in the prior art, the wall panel system of the present invention become particularly adaptable for use as exterior curtain walls as well as for load bearing interior walls.

In particular, the inventive system comprises a plurality of mechanically fastened and bonded layers including a steel stud frame, phenolic foam insulating with an R-value of 8.3 per inch, a strong, flame resistance material panel such as a medium density calcium silicate panel including cement, mineral fillers and treated natural organic fibers, a layer of sizing, a layer of fiberglass mesh, a coating including acrylic resin, fibers, vicron, fungicide, coloring agents, cement and water, and a sealer over the coating. Accordingly, the invention provides a strong but light weight curtain wall panel which mitigates potential fire hazard and stress related problems associated with the use of polystyrene in curtain wall systems. When panel is completed with Rockwood insulation and ⅝" interior gypsum sheathing, this system has been tested to a fire rating of two hours. This is the only system incorporating foam insulation that has obtained this rating.

BRIEF DESCRIPTION OF THE DRAWING

In the drawings, wherein similar reference letters are numerals denote similar features throughout the several views.

DETAILED DESCRIPTION OF THE INVENTION

Figure 1:
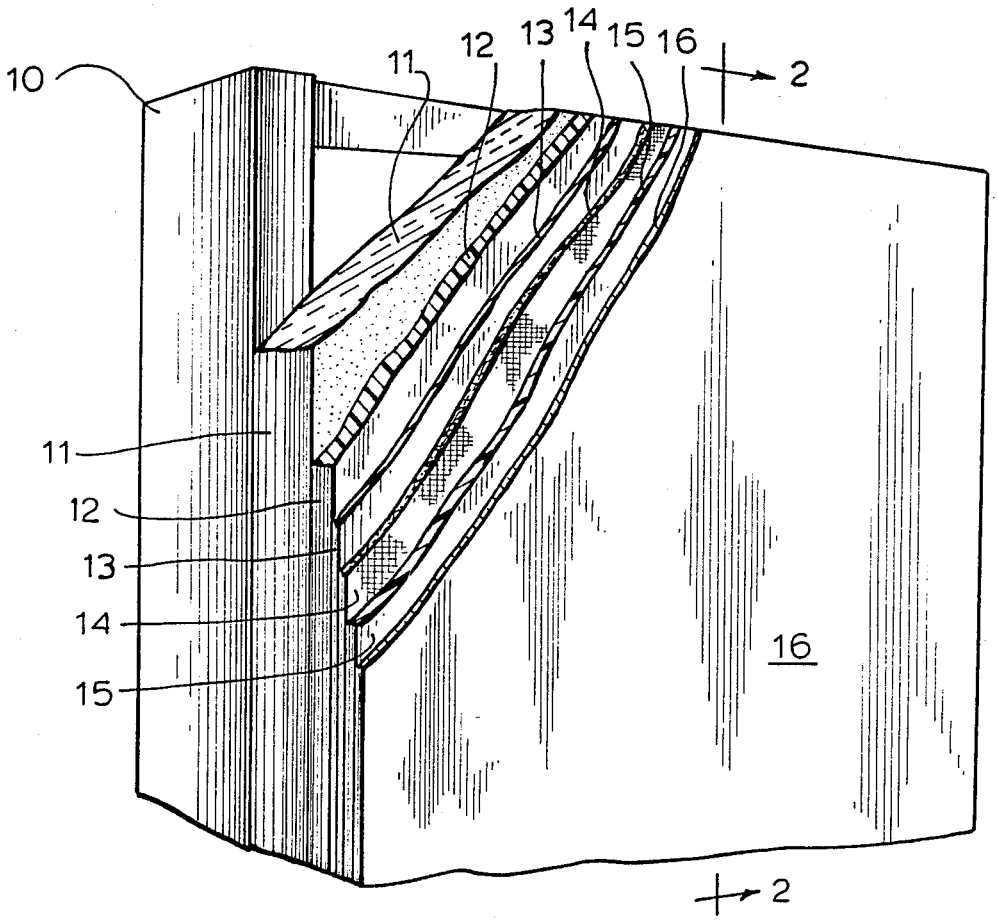
FIG. 1 is a perspective view of the wall panel, with various layers exposed sequentially.
Figure 2:
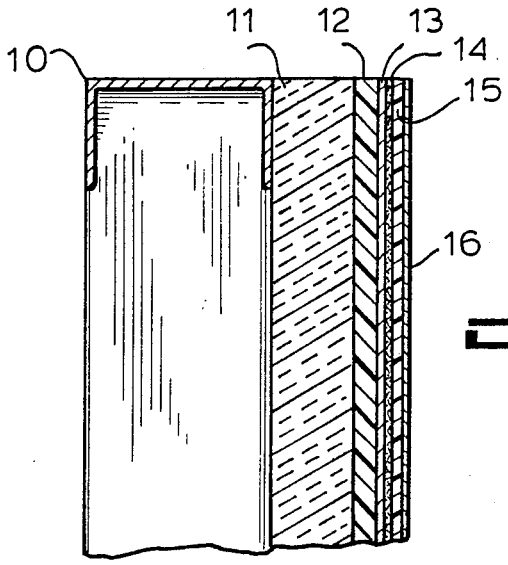
FIG. 2 is an end view of the wall panel shown in FIG. 1.

Turning now in detail to FIG. 1, the wall panel system of the present invention comprises a steel-stud frame 10 that is constructed from rust proofed galvanized steel, or similar rigid metal material; a layer of phenolic foam insulation 11 superimposed therewith, having an R-value of 8.3 per inch; a layer 12 of a medium density calcium silicate composition (known as "Eterspan"), including cement, mineral fillers and treated natural organic fibers; a layer 13 of sizing; a superimposed layer of Fiberglas mesh 14; a composite coating 15, (known as "Icote"), including acrylic resin, fiber, vicron, fungicide, coloring agents, cement and water and all covered by a sealer 16.

The steel stud frame 10 is adapted to be attached to the building's skeletal steel frame for easy installation and may therefore be provided with suitable brackets, clamp members and the like. Preferably it is in the form of a rectilinear frame having rearwardly extending sides, of U-shaped channel cross section. The present invention has an advantage over those prior known systems employing polystyrene insulation in that the phenolic foam insulation 11 has a high R-value, being thereby soundproof, weatherproof and fire resistant. In general, the insulation 11 is the thickness of the layers. Furthermore, the panel system is strengthened by the layering of the "Eterspan" medium i.e., the dense calcium silicate composite panel 12 upon it, which provides flame resistance and a strong resistance against stress impact.

The substrata of the steel stud frame 10, and the phenolic foam 11, are securely adhered together so as to be inseparable. Suitable adhesives, in- situ curing or fasteners may be used. The medium density calcium silicate composite panel 12 is of the type supplied under the trademark "Eterspan" by the Eternit Corporation of Village Center Drive, Reading, PA. 19607 and is applied directly onto the phenolic foam 11. The sizing 13 and fiberglas mesh 14 provide a base for the composite coating 15 which is of the type supplied under the trademark "Icote" by Icote International Inc., 109 Amwell Road, Bellemead, N.J. 08502, which may include various acrylic resins, fibers, vicron, fungicide, coloring agents, cement and water. The composite coating 15 such as "Icote", can be varied in any number of textures including smooth, rough, gravelled, sand blasted or trowelled and all made in a myriad of colors to suit the architectural design needs of the building to which the panel is attached. A sealer 16 is superimposed over the composite coating 15.

In the preferred embodiment the blend of the medium density calcium silicate composite panel 12 and the composite coating 15 should conform to the following gradations and mixed properties for the respective components:

| "ETERSPAN" | "ICOTE" |
|---|---|
| Medium density calcium silicate panel | Composite coating components |
| Components: | Acrylic Resin |
| Portland Cement | Fibres |
| mineral fillers | Vicron |
| treated natural organic | Fungicide |
| Fibers | and |
| | Coloring Agents |
| | To be added at time |
| | of mixing: |
| | Cement |
| | Water |

The present invention and preferred embodiments described herein is intended to develop a wall panel system to serially encapsulate various components which meet the foregoing objects of the present invention; namely to provide a lightweight wall system which gives desired exterior architectural features but also the physical characteristics of low combustibility, high impact resistance, good insulation, while complying with existing building code regulations and requirements.

Insulation is maximized by the use of a phenolic foam insulation having an R-value of 8.3 per inch.

The strength of the lightweight panel is provided by a flame resistant medium density calcium silicate layer, known as "Eterspan", having components including cement, mineral fillers and treated natural organic fibers.

In the present invention, the exterior architectural surface features are provided in a coating known as "Icote", including acrylic resin, fibers, vicron, fungicide, coloring agents, and at the time of mixing, the addition of cement and water. The "Icote" layer is then sealed. This provides a lasting finish with varied surface constituents which may be smooth, rough, gravelled, sand blasted or trowelled in any colors to suit the architectural design needs of the building exterior.

When the layers are described herein, are applied sequentially to a steel stud frame, the system is then easily fastened to skeletal building frames.

While only several embodiments of the invention have been shown and described, it will be obvious to those skilled in the art that many modifications may be made thereunto without departing from the spirit and scope of the invention.

What is claimed is:

1. A building curtain wall panel system for use in building construction comprising:

a plurality of adjacent, superimposed layered panels attached to a steel stud frame, said layered panels including sequentially a phenolic foam insulation layer, a medium density calcium silicate composite panel, a sizing layer, Fiberglas mesh, a composite coating, and a sealer.

2. The panel system according to claim 1 wherein the medium density calcium silicate composite panel comprises a mixture of cement, mineral fillers and treated natural organic fibers.

3. The panel system according to claim 1 wherein the composite coating includes a mixture of acrylic resin, fiber, vicron, fungicide, coloring agents, cement and water.

4. The panel according to claim 1 wherein the medium density calcium silicate composite panel comprises: Portland Cement, mineral fillers, treated natural organic, and fibers; and the composite coating comprises; acrylic resin, fibres, vicron, and a fungicide, coloring agents, cement and water.

5. The panel system according to claim 1 wherein said phenolic foam insulation has an R-value of at least 8.3 per inch.

* * * * *